US008246783B2

(12) United States Patent
Zaoralek

(10) Patent No.: US 8,246,783 B2
(45) Date of Patent: Aug. 21, 2012

(54) DEVICE AND METHOD FOR SURFACE PROCESSING WEBS OF PAPER AND SIMILAR ENDLESS NON-WOVENS BY MEANS OF A HEATABLE ROLLER

(75) Inventor: Heinz-Michael Zaoralek, Koenigsbronn (DE)

(73) Assignee: SHW Casting Technologies GmbH, Aalen (DE)

( * ) Notice: Subject to any disclaimer, the term of this patent is extended or adjusted under 35 U.S.C. 154(b) by 1343 days.

(21) Appl. No.: 10/522,892

(22) PCT Filed: Jul. 31, 2003

(86) PCT No.: PCT/DE03/02581

§ 371 (c)(1), (2), (4) Date: Apr. 8, 2009

(87) PCT Pub. No.: WO2004/015199

PCT Pub. Date: Feb. 19, 2004

(65) Prior Publication Data

US 2009/0199989 A1 Aug. 13, 2009

(30) Foreign Application Priority Data

Aug. 1, 2002 (DE) ..... 102 35 142

(51) Int. Cl.
*D21F 3/02* (2006.01)

(52) U.S. Cl. ..... 162/206; 34/126; 492/20

(58) Field of Classification Search ..... 492/20, 492/46; 34/126, 110, 117; 165/89, 186; 162/206

See application file for complete search history.

(56) References Cited

U.S. PATENT DOCUMENTS

| | | | | |
|---|---|---|---|---|
| 5,662,572 | A * | 9/1997 | Zaoralek | 492/20 |
| 6,039,681 | A * | 3/2000 | Heinz-Michael | 492/20 |
| 6,708,407 | B2 * | 3/2004 | Leinonen et al. | 29/895.32 |
| 6,796,371 | B2 * | 9/2004 | Eppli et al. | 165/89 |
| 6,821,237 | B1 * | 11/2004 | Isometsa et al. | 492/46 |
| 7,097,605 | B2 * | 8/2006 | Zaoralek | 492/46 |
| 2003/0181303 | A1 * | 9/2003 | Leinonen et al. | 492/46 |

FOREIGN PATENT DOCUMENTS

| | | | |
|---|---|---|---|
| EP | 0507737 | A1 | 10/1992 |
| EP | 0506737 | B1 | 7/1994 |
| EP | 0598737 | B1 | 3/1997 |
| EP | 0598737 | B2 | 12/2001 |

* cited by examiner

*Primary Examiner* — Mark Halpern

(74) *Attorney, Agent, or Firm* — Fish & Richardson P.C.

(57) ABSTRACT

A roller for thermal pressure treatment of web-type media such as paper or non-wovens, provided with an inner heating system and comprising a base body made of hardened and tempered wrought steel or alloyed cast iron, an intermediate layer applied to the surface thereof and a hard wearing layer applied thereon. Peripheral bores or canals extending parallel to the axis are arranged in the base body of the roller at a regular distance from the surface, being distributed in a regular manner on the circle formed about the roller axis. The materials used and the arrangement of the peripheral bores are such that the roller can be used in calanders in a method wherein the surface temperatures of the roller exceed 140° C., the heating capacity is more than 35 kW/m$^2$, operational speeds are more than 1200 m/min, line pressures are greater than 250 kN/m and the processed webs of material weigh more than 45 g/m$^2$ and have a degree of moisture of over 5%.

8 Claims, 1 Drawing Sheet

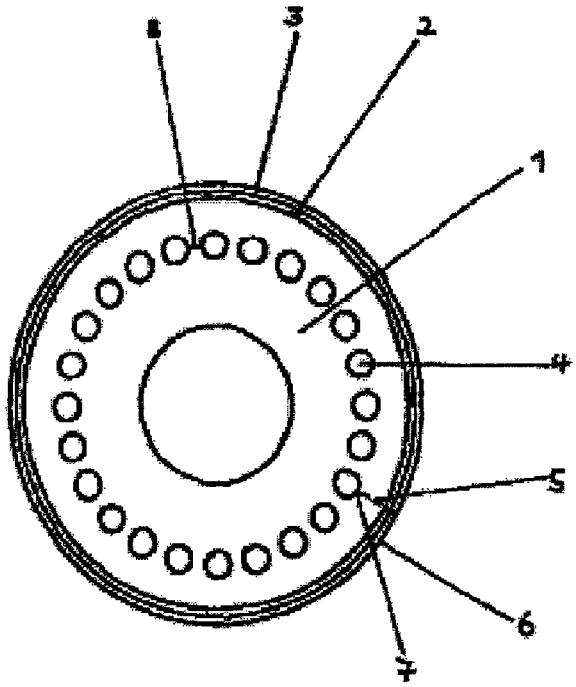
8
3
2
1
4
5
6
7

DEVICE AND METHOD FOR SURFACE PROCESSING WEBS OF PAPER AND SIMILAR ENDLESS NON-WOVENS BY MEANS OF A HEATABLE ROLLER

This application is a 371 of PCT/DE03/02581 filed 31 Jul. 2003.

The invention relates generally to heated calender rollers such as are used especially in the surface treatment of paper having high moisture levels, at high throughput speeds and high temperatures, with high line loads in the roller gaps. The invention further relates to methods in which use of a roller as specified in the invention results in an improvement of the surface and inner quality of the processed webs of material.

CURRENT STATE OF THE ART

So-called calendering, which is performed at the end of the manufacturing process, represents a significant stage in the manufacturing of paper or similar non-wovens. In this stage of the process, the web of material passes through one or more gaps between rotating rollers under high pressure, with the surfaces of one or more of the rollers being heated. This treatment process gives the surface of the web of material a smooth and shiny appearance. With the proper selection of temperature and pressure levels, and by adjusting specific residual moisture levels in the web of material, it is also possible to affect the internal structure of the web of material, so that, for example, applied liquids, such as inks and dyes, can be more or less rapidly absorbed. In this process two rollers, or multiple rollers, can be used, between which the web of material passes. In the latter case the rollers are customarily arranged one above the other, resting against one another, with a potential deviation from vertical of up to 45%. In typical, but not all, applications, with the multi-roller calenders operating in a vertical on-line orientation, in other words as the final component in the papermaking machine, heated rollers are interchanged with non-heated rollers that are covered in an elastic material. The heated rollers are customarily heated from the inside by means of a fluid heat transfer medium. In the roller gap, in other words at the point at which the rollers touch one another and the web of material passes through, the high line pressure levels are interrupted.

Since about 1982 rollers of this type have been produced primarily from chill casting. Such rollers comprise an exterior layer made of white cast iron and a core made of gray iron. If the roller body is produced using the static permanent-mold casting process, a transition layer measuring a few centimeters thick will form between the two material types, in which white cast iron and gray iron mix. With roller bodies that are produced via centrifugal casting, this zone in which the white cast iron (shell) and the gray iron (core) fuse is so thin as to be negligible.

This type of roller is customarily heated using heated thermal oil, which passes through the body of the roller via axially parallel bores located near the surface of the roller (so-called peripheral bores). The bores, which have a diameter of between 25 and 50 mm, are predominantly arranged entirely within the gray iron (core), as in this area the difficult boring process can be better controlled. In such cases no drifting of the bores from the harder layers into the softer layers of the material occurs. Up to now, the accepted opinion has been that the bores should be located as close as possible to the surface of the roller, in order to allow a rapid transmission of the greatest possible amount of heat to the surface of the roller. This condition conflicts with the fact that, if at all possible, the bores should not be located in the area of the white cast iron or in the transition layer, for the above-described processing reasons, but also due to the substantially lower heat conductivity of the white cast iron relative to the gray iron. Although good temperature equalization in the direction of the periphery could take place below the white cast iron shell, the thermal energy, based upon the cross-section of the roller, would be applied nearly punctiform at the location of the peripheral bores.

In order to make the roller temperature peripherally uniform and to compensate for the temperature loss that occurs in the thermal oil as it passes through long rollers, such rollers are designed as DUOPASS, TRIPASS or TRIPASS-2 constructions, depending upon how frequently the thermal oil is to pass through the body of the roller. In the TRIPASS-2 construction, in each case three bores are grouped in such a way that oil flows through two bores from the lead side and returns to this side through a single bore. The improvement in heat transfer caused by the doubled flow rate in the return bore compensates for the temperature loss that the returning oil has suffered.

Following an analysis of damage to rollers that occurred during the mid 1980's as a result of thermal overload, the construction and the manufacture of the rollers were generally improved and the chill casting method was modified in terms of its metallurgic properties. Since 1986 many hundreds of rollers manufactured by chill casting and having heating capacities of more than 28.5 kw/m$^2$ have been placed in use. (See P. Rothenbacher, et. al.: Report about later developments with chilled iron rolls of high precision for machine calenders and supercalenders for high temperature calendering, EUCEPA XXII (Florence) Conference Proceedings, Oct. 6-10, 1986, pp. 25-1-25-17).

Frequently, thermal rollers have also had to be produced from materials other than chill casting for various reasons, for example when for workplace safety reasons, quality specifications require a generally standardized material. For chill casting only manufacturer's standards exist. Rollers for GLOSS calenders, for example, were made from ductile cast iron or from gray cast iron. In supercalenders on which silicon-based papers are smoothed and which are heated with steam due to the high temperatures that are required, rollers made of forged steel were used. Often the rollers were provided with thin, hard layers of hard chrome or other hard layers to protect them against wear and corrosion. The literature on surface layers points to the alternative use of such layers as early as the late 1980's.

Thus a firm would produce roller bodies with peripheral canals in such a way that a steel pipe would be permanently shrunk onto a steel core that had grooves cut into its surface and extending in an axial direction. A thin layer of the surface of this steel pipe was then altered via carburization (case hardening) until it achieved a hardness of more than 550 HV, and could be sanded to a slight roughness. Depending upon the duration of the case hardening, which determines the diffusion depth of the carbon, layer thicknesses of between a few tenths of a millimeter to a few millimeters could then be achieved (For comparison see: Michael Zaoralek: The Application of Different Designs of Heated Calender Rolls, Tappi Paper Finishing and Converting Conference Proceedings, pp. 153-158, October 1989).

At the same time it was also known that peripherally bored rollers made of forged steel can be equipped with a thin surface layer made of martensitic steel for the purpose of increasing their resistance to wear. To accomplish this, the layer is heated briefly and then quenched. Here the heating is predominantly inductive. Again, depending upon the frequency of the inductor a wear layer of greater or lesser thickness can be created. High-frequency currents penetrate only a few tenths of a millimeter into the surface of the roller. Hardness levels of more than 600 HV can be achieved in this manner.

High-temperature, peripherally bored calender rollers made of forged steel with supplementary thin wearing layers made of hard chrome or even of hard metal or ceramic have been produced for more than 20 years by a Japanese firm for use in the paper industry. In this case the heating is accomplished primarily inductively on an inner central bore by means of a central inductor coil core. Because this heating is very uneven, the peripheral canals are partially filled with a vaporizing medium, for example water. In local overheated areas, the water vaporizes. Because the generated steam condenses at certain points of insufficient temperature, the necessary thermal energy is transferred there. In these areas the roller in operation corresponds to a roller having peripheral bore heating.

EP 0 598 737, dated May 13, 1992, describes a roller that corresponds in its constructive design entirely to rollers known at that time and made from chill casting, in terms of wall thickness, arrangement, and diameter of the peripheral bores, however the roller of the invention is made of two material types, namely a first base material, for example forged steel, cast steel, non-chill-cast iron, or ductile cast iron (nodular cast iron), and a thin surface layer of a second material, such as cermet or ceramic. According to the description, this roller is able to withstand the relatively low minimum loads of, for example 26,796 w/m$^2$, line pressures of 175,000 nm/m and surface temperatures of 176.6° C. Under such operating conditions, which were customary for the so-called soft calenders being built around 1990, practical experiments with paper moisture levels of 4-5% and operating speeds of less than 950 m/min reportedly produced satisfactory results with respect to the variation in gloss levels on the paper surface.

DESCRIPTION OF THE INVENTION

Especially with modern multi-roller calenders, such as those currently offered by paper machine manufacturers under the trade names OptiLoad, Janus and ProSoft, roller loads, especially when the rollers are used in on-line operation with high-speed paper-making machines, can be substantially higher than those represented in EP 0 598 737. Today, operational speeds are around 2,000 m/min, line pressures can be as high as 500 kn/m, and paper moisture levels can range between 5 and 9%.

In multi-roller calenders in which the rollers are stacked vertically or at an inclination angle of approximately 45%, constructive efforts are focused on reducing the diameter of the rollers. This plays an important role in the cost of the rollers and thus the cost of the calender. At the same time, however, at a certain operating speed the rpm of the rollers and therefore the number of paper contacts per unit of time are increased, thereby increasing the specific heating capacity to be transmitted.

In the operation of the rollers—especially when the predominant base material is homogeneous and highly thermally conductive—this can have significant consequences. Due to the proximity of the peripheral bores to the roller surface, a substantially higher surface temperature develops directly above the peripheral bores, especially the bores in which the temperature of the heat transfer fluid is higher (in other words the bores that carry the fluid "away"), than in the areas between the bores or above bores in which the temperature of the heat transfer fluid is lower (in other words the bores that "return" the fluid). The uniformity of the temperature at the circumferential surface of the roller then is no longer sufficient.

In addition, an effect referred to as "polygon formation" occurs. Because the material expands more at the hotter points, the roller periphery becomes polygonal, which is suspected of being responsible for certain fluctuations in the calender, referred to as "barring". This is the name given to movements of the entire roller body in the direction of the roller gap, at a multiple of the rotational speed. The periodic fluctuations in the line load in the roller gaps triggered in this manner result in striated wear patterns on the surfaces of the—unheated—elastic rollers as well as on the surfaces of the hard thermal rollers. This forces the rollers to be adjusted more frequently via repolishing than would otherwise be necessary, resulting in a loss in production due to roller replacement, additional costs for polishing, and premature wear of both the costly hard and the elastic layers.

The object of the invention is to largely eliminate these disadvantages.

According to the invention, this object is attained with the novel configuration of the hard rollers specified in claim 1 for use in calenders. The processing conditions that are advantageously achieved by use of the roller specified in the invention are disclosed in claim 2.

The roller of the invention is equipped with three material layers, arranged concentrically around one another, specifically a base material comprising a roller body made, for example, of hardened and tempered forged steel, on the surface of this a second material layer as a so-called intermediate layer, and on its surface an outer layer made of wear-resistant and very hard material.

Because steel is selected as the base material rather than other materials such as gray cast iron or ductile cast iron, the elasticity modulus of the roller, at around 210,000 n/mm$^2$, is much higher than that of a roller made, for example, from chill casting, at ca. 135,000 n/mm$^2$. A roller having the same diameter but made of steel thus has an approximately 25% higher characteristic frequency than one made from chill casting. Thus at a certain rpm it is correspondingly farther away from its critical rpm and thus runs more quietly and is less inclined toward fluctuations in the calender under otherwise equivalent operating conditions, so that the risk of barring is substantially reduced.

Similar conditions can be achieved with a base body made of alloyed cast iron, which must be correspondingly capable of hardening.

The effect of residual fluctuations in the roller gap that nevertheless remain, and thus the effect of residual striated pressure wear, can be further minimized with a hard roller surface. According to the invention this can be achieved by applying a hard wearing layer, such as hard chrome, hard metal, or various carbides or ceramics, for example. However, in order to provide the desired protection, this layer must have a minimum hardness of 600 HV.

Due to the high heating capacities that are to be applied by the roller to the web of material passing through, and due to the great temperature differences between the base material of the roller body and the hard surface layer that are associated with this, an intermediate layer is necessary, which is designed to equalize the different thermal expansion coefficients of the two materials. It is selected such that its thermal expansion coefficient lies between those of the base material and the hard surface layer.

However, in order to prevent the applied hard surface layer from becoming damaged by periodic line pressure fluctuations, a sufficiently stable base for the two outer layers is also necessary. In order to provide this the base material must have a minimum hardness of 400 HV. On the other hand, the base material cannot be too hard, because if that is the case, adequate adhesion to the outer layers cannot be achieved. The maximum hardness limit is approximately 620 HV.

The desirable establishment of uniformity in the surface temperature, with which the polygon formation and thus the high-frequency stimulation of fluctuations are reduced, can be achieved by positioning the peripheral bores farther away from the surface of the roller than has thus far been customary. Up to now specialists in the field have felt that the peripheral bores should be positioned as close as possible to the surface of the roller in order to achieve the best and highest possible transfer of heat from the heat transfer medium flowing through the roller to the roller surface. Surprisingly, however, it has been found that this view is incorrect.

Expanding the distance of the peripheral bores from the surface of the roller from 50 mm, previously viewed as the greatest allowable distance, to 60 mm, for example, merely requires an increase in the inlet temperature of the heat transfer oil by an amount that will increase the average temperature difference between the oil temperature and the surface temperature by 20%. For example, in the case of a 60° C. temperature difference, this amounts to only 12° C. This increase can also be largely replaced by an increase in the flow rate of the thermal oil, which can be achieved by installing displacers in the peripheral bores.

Another argument against expanding the distance between peripheral bores and the roller surface that heretofore has been voiced, namely that this would increase the load from thermal stresses in the roller surface to an unacceptable degree, has been found to be incorrect. As calculations involving finite elements have shown, in the case discussed above this load increases by only ca. 7%, in other words insignificantly.

The invention thus provides that the distance between the peripheral bores and the roller surface be greater than 50 mm, with the establishment of the precise measurement to be determined constructively, using conventional known methods, taking into account the other particulars of the roller, especially its diameter and thus circumference, and the operating speed.

Below, the constructive characterizing features of the roller of the invention are described in detail with reference to the roller cross-section illustrated in FIG. 1.

On the roller base body 1—shown in simplified form—are the intermediate layer 2, applied to the circumferential surface of the base body, and the outer wearing layer 3, applied to the circumferential surface of the intermediate layer. The layers 2 and 3 are thin relative to the diameter of the roller base body.

In the roller base 1 are peripheral bores 4 that extend axially parallel. The distance 5 between the surface of the roller 6 and the surface point 7 of the wall of the peripheral bore 4 that is closest to the surface is equal for each peripheral bore, so that the bores are arranged in a circle having a uniform diameter around the axis of the roller. The distance 8 between the two adjacent points in the walls of two peripheral bores is equal among all the peripheral bores, so that the peripheral bores lie evenly distributed around the imaginary circle around the roller axis.

Obviously the canals, characterized here as the bore 4, that are designed to carry the fluid heat transfer medium, need not be bores that are circular in cross-section, and may instead, depending upon the method used to manufacture the roller, take on other geometric cross-sectional shapes, such as square, rectangular, polygonal, or elliptical shapes, for example. In such cases the dimensions 5 and 8 must be correspondingly understood.

The invention claimed is:

1. A roller for use in the thermal pressure treatment of roll goods comprising:

a roller base body made of tempered and hardened forged steel or an alloyed cast iron having a hardness of at least 400 HV and no more than 620 HV;

an intermediate material layer applied to the roller base body;

an outer material layer applied to the intermediate material layer, wherein the outer material layer is a hard wearing layer that has a minimum hardness of 600 HV; and axially parallel peripheral bores designed to carry a fluid heat transfer medium, the bores being arranged in the roller base body equidistant from a roller axis and equidistant from one another, wherein a distance of the peripheral bores from a roller surface, measured to a point on an individual bore closest to the roller surface, is greater than 50 mm, and wherein the intermediate layer has a thermal expansion coefficient that is between those of the outer wearing layer and the roller base body.

2. The roller of claim 1, wherein the roll goods comprise paper.

3. The roller of claim 1, wherein the outer material layer comprises hard chrome, hard metal, carbide or ceramic.

4. The roller of claim 1, wherein bores comprise a square, rectangular, polygonal, or elliptical shape.

5. A method of thermal pressure treatment of roll goods in a multi-roller calendar, characterized in that:

passing a web of material between a first roller and a second roller, wherein:

the web of material weighs more than 45 g/m$^2$ with a moisture content level of more than 5%;

a surface temperature of at least the first roller is greater than 140° C. and a heating capacity of at least the first roller relative to the web of material lies above 35 kw/m$^2$;

an operating speed of the calendar is greater than 120 m/min; and a line pressure in a roller gap adjacent to at least the first roller is greater than 250 kn/m; and at least the first roller comprises:

a roller base body made of tempered and hardened forged steel or an alloyed cast iron having a hardness of at least 400 HV and no more than 620 HV;

an intermediate material layer applied to the roller base body;

an outer material layer applied to the intermediate material layer, wherein the outer material layer is a hard wearing layer that has a minimum hardness of 600 HV; and axially parallel peripheral bores designed to carry a fluid heat transfer medium, the bores being arranged in the roller base body equidistant from a roller axis and equidistant from one another, wherein a distance of the peripheral bores from a roller surface, measured to a point on an individual bore closest to the roller surface, is greater than 50 mm, wherein the intermediate layer has a thermal expansion coefficient that is between those of the outer wearing layer and the roller base body.

6. The method of claim 5 wherein the roll goods comprise paper.

7. The method of claim 5 wherein the outer material layer comprises hard chrome, hard metal, carbide or ceramic.

8. The method of claim 5 wherein bores comprise a square, rectangular, polygonal, or elliptical shape.

* * * * *

UNITED STATES PATENT AND TRADEMARK OFFICE

CERTIFICATE OF CORRECTION

PATENT NO. : 8,246,783 B2
APPLICATION NO. : 10/522892
DATED : August 21, 2012
INVENTOR(S) : Heinz-Michael Zaoralek It is certified that error appears in the above-identified patent and that said Letters Patent is hereby corrected as shown below:

Title Page, Column 2, Abstract, line 11, please delete “calanders” and insert therefor -- calendars --;

Column 6, line 43, claim 5, please delete “120” and insert therefor -- 1200 --;

Column 7, line 1, claim 6, please delete “claim 5” and insert therefor -- claim 5, --;

Column 7, line 3, claim 7, please delete “claim 5” and insert therefor -- claim 5, --; and Column 8, line 1, claim 8, please delete “claim 5” and insert therefor -- claim 5, --.

Signed and Sealed this
First Day of January, 2013

David J. Kappos

David J. Kappos
*Director of the United States Patent and Trademark Office*